United States Patent [19]

Ishikawa et al.

[11] Patent Number: 4,832,908

[45] Date of Patent: May 23, 1989

[54] LOW THERMAL EXPANSION CAST ALLOY

[75] Inventors: Katsuhisa Ishikawa; Ryoji Yamamoto; Takayuki Tsukahara, all of Shimane, Japan

[73] Assignees: NEC Corporation; Hitachi Metals Precision Ltd., both of Tokyo, Japan

[21] Appl. No.: 160,782

[22] Filed: Feb. 19, 1988

[51] Int. Cl.[4] ..... C22C 38/08

[52] U.S. Cl. ..... 420/95; 420/94

[58] Field of Search ..... 420/95, 94

[56] References Cited

U.S. PATENT DOCUMENTS 1,942,261 1/1934 Scott ..... 420/95

FOREIGN PATENT DOCUMENTS 364696 1/1932 United Kingdom ..... 420/95

OTHER PUBLICATIONS

Expansion Properties of Low-Expansion Fe-Ni-Co Alloys, Trans. AIME 193 Institute of Metals Div., vol. 89 pp. 508-537.

*Primary Examiner*—Deborah Yee

*Attorney, Agent, or Firm*—Sughrue, Mion, Zinn, Macpeak & Seas

[57] ABSTRACT

A novel low thermal expansion cast alloy is provided. The alloy consists of, by percents by weight, 0.02 to 0.25% of C, 30.5 to 33.3% of Ni, 4.0 to 6.0% of Co, 0.005 to 0.70% of Mn, 0.005-0.50% of Si and the balance substantially of Fe, with the proviso that % C≧3.0285-0.0936 x % Ni (% C and % Ni are weight % of C and Ni). By such composition, micro-segregation of Ni can be reduced and the Ni content range showing the low thermal expansion coefficient can be broadened to an extent of substantially enabling mass production by a casting process in place of the conventional forging or rolling process. The average thermal expansion coefficient at the temperature range from - 50 to 120° C. of the cast alloy is not more than $1.5\times10^{-6}$/°C.

1 Claim, 1 Drawing Sheet

LOW THERMAL EXPANSION CAST ALLOY

BACKGROUND OF THE INVENTION

1. Field of the invention

The present invention relates to a low expansion cast alloy showing an average thermal expansion coefficient of not higher than $1.5\times10^{-6}$/°C. at a temperature in the range of −50° to 120° C.

2. Description of the Prior Art

Recently, technology including a processing technique has been developed in respect of minuteness and thus there is an increasing need for effecting a size control in the order of microns or submicrons. In general, a substance shows an expansion or contraction phenomenon in accordance with the change of a temperature, and so, in order to have size control in the submicron order, it is required to meet either one or both of the requirements as follows:

(1) to keep the ambient environments at a constant temperature, and (2) to use a material which retains low expansion in a wide temperature range.

As to the latter requirement (2), for example in iron base alloys, the so-called "invar" material of 36 Ni (nickel) series and also "super invar" material of 31 Ni-5 Co (cobalt) series are well known, and have average thermal expansion coefficients of $\alpha_{0°\ to\ 100°\ C.}\leqq2\times10^{-6}$/° C. and $\alpha_{0°\ to\ 100°\ C.}\leqq1\times10^{-6}$/° C., respectively. The "super invar" material, which has the lowest expansion coefficient among the commercially available iron based alloys, has been produced in a considerable amount, but it is provided as a forged or rolled material without exception. As the usage is broade[illegible] and the production amount accordingly is incr[illegible]er, problems have been noted in respect [illegible] conditions and the productivity.

The stable structure of the "super invar" material comprises a single austenite phase, but its chemical component composition giving the low thermal expansion is close to the composition giving the martensitic transformation when it is cooled from a high temperature. Therefore, there is a great risk of martensite generation even by a slight fluctuation in the chemical composition.

Further, the martensitic transformation temperature (Ms point) considerably changes dependent upon the relative amounts of Ni and Co components. In effect, the Ms point normally is considered as not higher than −70° C., but particularly in a composition of low Ni content, it is possible that the Ms point elevates nearly to the ice point or freezing-point (0° C.). Accordingly, there is a problem in the special use at a temperature below the ice point. For example, in a high-altitude flight, the temperature of the luggage space of an aircraft is lowered nearly to −40° C. For this case, the martensitic transformation occurs in the course of transportation, resulting in an extremely high thermal expansion coefficient. It is therefore required to strictly control the composition in a narrower range, even for a forged or rolled material.

On the other hand, in respect of productivity, the "super invar" material is not so hard but is a representative difficult to machine. As the demand has increased, machining processes required from the rough shape to the final product naturally have increased. To reduce the time of machining processes, trials have been made in order to obtain a work piece finished in the shape almost equal to the final product by a casting process such as an investment casting mold process. However, the cast products have greater micro-segregation than the forged or rolled products and so said trials have not yet been successful in providing a practicable process suitable for mass-production. In effect, even when a cast product is produced in compliance with the known requirements for chemical composition of the forged or rolled products, the properties of "super invar" material are often lost, because considerable segregation occurs particularly as to Ni, which is an austenite stabilizing element, and because the martensite is generated even at a normal temperature in the local Ni poor portions. The present inventors have confirmed that the difference of Ni weight percents between the Ni rich portions and the Ni poor portions discriminated by microscopic observation amounts to 2.0–2.5% in some cases. In view of the fact that the control of Ni weight percents in a forged or rolled product showing almost no segregation is made within a range not broader than 2%, it seems almost impossible to avoid local martensite transformation in a cast product at a room temperature or through a sub-zero cooling to slightly below the ice point.

SUMMARY OF THE INVENTION

An object of the present invention is, therefore, to solve the above mentioned problems and to provide a novel low expansion cast alloy which can be cast without impairing castability and show the thermal expansion characteristics after sub-zero cooling that are substantially equal to and covering the range between those of "super invar" and "invar" materials.

Through intensive and extensive researches and repeated experiments made on cast materials in an effort to solve the above mentioned problems, the present inventors have found that by addition of carbon C to the 31 Ni-5 Co series iron alloys, segregation of Ni is reduced, the amount of Ni required to have low expansion coefficient is shifted to a lower Ni range and also is allowed to have a broader range and the stable austenite single phase structure is maintained even after a sub-zero cooling to −50° C., and have thus completed the present invention.

More particularly, according to the present invention, a low expansion cast alloy is provided by incorporating into an alloy having a composition by percents by weight of 30.5–33.3% of Ni, 4.0–6.0% of Co, 0.005–0.7% of Mn (manganese), 0.005–0.5% of Si and the balance substantially of Fe (iron), a carbon C in an amount of 0.02–0.25 percent by weight with the proviso that $\%\ C\geqq3.0285-0.09362\times\%\ Ni$ (% C and % Ni mean weight percents of C and Ni, respectively).

In the present invention, the carbon C acts to lower the Ms point to stabilize the austenite, reduce the micro-segregation of Ni, and shift the amount of Ni required to show low expansion coefficient to a lower Ni range while broadening the range. The amount of the carbon C is limited to 0.02–0.25 weight %, since less than 0.02 weight % does not bring about any appreciable effect and more than 0.25 weight % tends to cause boiling of the carbon in the course of melting to make the melting operation itself difficult and also cause local precipitation of graphite. Further the amount of the carbon C has to satisfy the condition of the following formula correlative to the amount of Ni:

$$\%\ C\geqq3.0285-0.09362\times\%\ Ni$$

(wherein % C and % Ni respectively mean the weight percents of C and Ni). If not, martensite transformation occurs after sub-zero treatment at −50° C., even if the amount of the carbon C is within the limited range of 0.02–0.25 weight %.

The other components of the alloy of the present invention are incorporated and limited as to their amounts for the following reasons:

First, Ni is limited to 30.5–33.3 weight %, since less than 30.5 weight % Ni makes the austenite phase unstable and shows local martensite transformation even at a room temperature; and moreover, in order to obtain the stable austenite phase by the addition of the carbon, requires addition of the carbon in amount of about 0.25 weight percent, which corresponds to the maximum of the carbon content limitation, to obtain the stable structure after sub-zero cooling to −50° C. The maximum Ni content 33.3 weight % is limited for the reason that more than 33.3% makes average thermal expansion coefficient $\alpha_{-20° \text{ to } 120°}$ C. greater than $1.5\times10^{-6}$/°C. irrespective of the blend ratio of other chemical components.

Cobalt Co has an effect to broaden the range of low expansion coefficient. Because less than 4.0 weight % brings about only very small effect and requiring a high Ni content of not less than 33.5 weight %, which is too much to obtain the low expansion coefficient, and more than 6.0 weight % contrarily makes the alloy unstable, the Co content is limited to 4.0–6.0 weight %.

Silicon Si content should preferably be low, since as it increases, the expansion coefficient is worsened and the transition point from a low expansion coefficient to a high expansion coefficient is lowered. From the viewpoint of casting, hov :ver, Si should preferably be added in a small amou t as a deoxidizer. Also for the purpose of improving .he fluidity, Si is added in an amount of not more than 0.50 weight % which does not badly affect the thermal expansion coefficient. Less than 0.005 weight % belongs to a category of unavoidable impurities and also is not practicable under the production conditions of the present alloy as above mentioned.

Similarly to Si, Mn lowers the transition point and worsens the thermal expansion coefficient, but in a degree smaller than Si. The maximum content of Mn limited to 0.70 weight % corresponds to that of Si limited to 0.50 weight % with respect to the influence against the thermal expansion coefficient. Mn acts as a deoxidizer like Si and also as a desulfurizer. The minimum content of Mn is limited to 0.005 weight % for the reason of practicability under the production conditions as in the case of Si.

DESCRIPTION OF THE PREFERRED EMBODIMENTS

Figure 1:
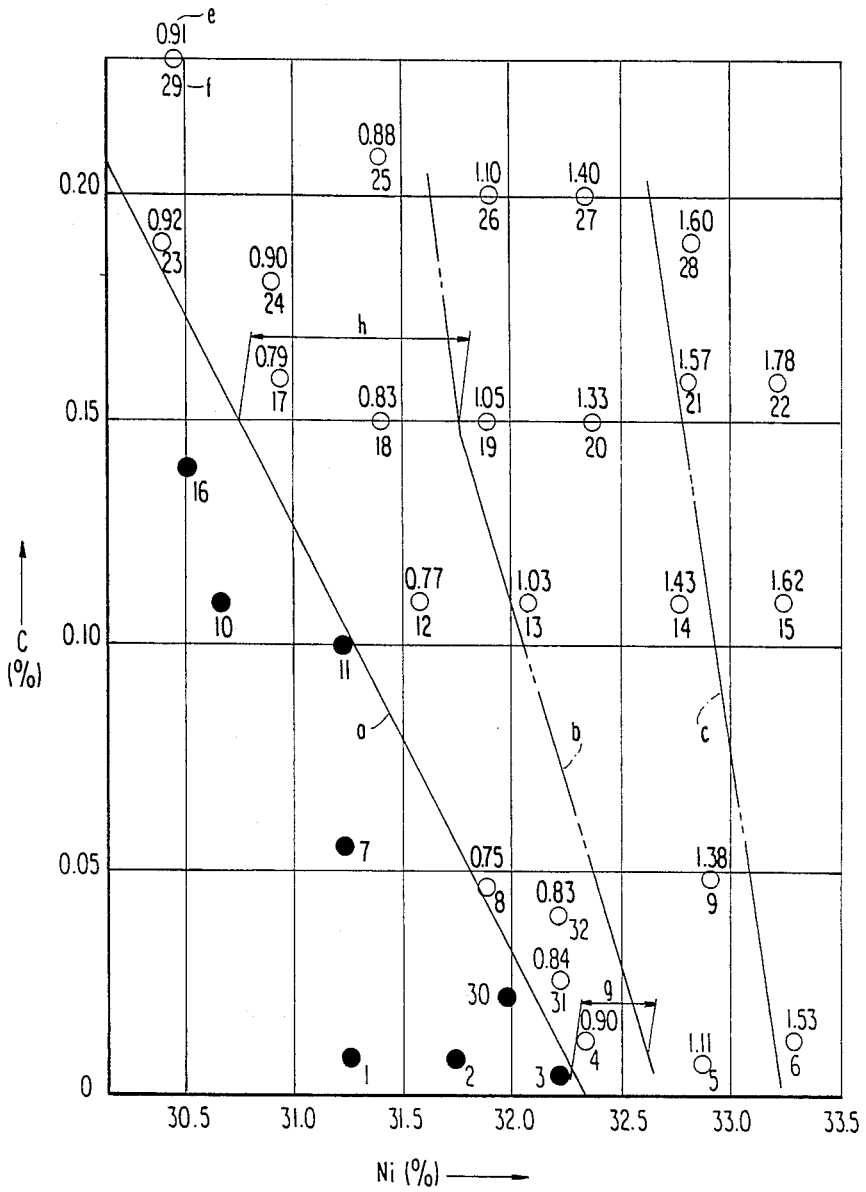
FIG. 1 shows a diagram wherein % C and % Ni are plotted with respect to the alloys of the present invention and the alloys of references described in the working Examples given below, and wherein the relations of the % C and % Ni to the martensite generation in the alloys after sub-zero treatment and the thermal expansion coefficients of the alloys are indicated.

The present invention will be explained in further detail with reference to the embodiments shown in the following working Examples.

1. Production of test samples

In a high frequency induction furnace, alloy components of various compositions are molten and poured into a mold prepared by an investment casting mold method. The mold is shaped to give a product in size of 15×100 mm. After the casting, the molding material is gated and the sprue is cut off. The obtained cast product is finished by grinding and subjected to a heat treatment at 1,050° C. for one hour, an air cooling treatment and then a sub-zero treatment of dipping in the mixture of dry ice and ethyl alcohol at −50° C. for 20 minutes. From the thus treated cast product, a test piece for measurement of thermal expansion coefficient and a test piece for observation of micro-structure are cut out and both pieces are simultaneously subjected to a heat treatment at 120° C. for 4 hours and then air cooled.

2. Test methods

The thermal expansion coefficient is determined by measuring the expansion of the test piece during heating from −20° C. to 120° C. at a temperature elevation speed of 3° C./min and calculating the average thermal expansion coefficient on the basis thereof.

The micro-structure is observed through a microscope in magnification of ×100 after buffing the microscopic surface of the test piece and etching it by aqua regia and acetic acid to determine whether martensite is generated or not. After the micro-structure observation, the same test piece is subjected to a line analysis and a micro-portion quantitative analysis of Ni by means of EPMA to determine the segregation degree of Ni.

3. Test results

The compositions of the alloys of the test pieces numbered 1 to 38 are shown in the "Table-1" given below, and the thermal expansion coefficients, the martensite generation and the segregation degree of Ni as determined with the same numbers of the test pieces are shown in the "Table-2" given below.

In the "Table-1" and the "Table-2", the mark * attached to some of the test piece numbers means that the compositions of the test pieces of such numbers do not satisfy the aforementioned correlative formula % C≧3.2085−0.09362×% Ni; character X means that the test pieces of the group X are those produced from the chemical compositions of the prior art forged or rolled low expansion alloys; and character Y means that the test pieces of the group Y are those produced from the chemical compositions of the present invention excepting the test pieces marked * as above noted.

TABLE 1

| | Test Piece No. | Chemical Components C | Si | Mn | Ni | Co |
|---|---|---|---|---|---|---|
| X | 1* | 0.008 | 0.15 | 0.17 | 31.22 | 5.03 |
| | 2* | 0.007 | 0.16 | 0.22 | 31.74 | 5.08 |
| | 3* | 0.004 | 0.16 | 0.25 | 32.21 | 5.01 |
| | 4 | 0.011 | 0.15 | 0.19 | 32.30 | 5.03 |
| | 5 | 0.007 | 0.16 | 0.19 | 32.87 | 5.09 |
| | 6 | 0.011 | 0.19 | 0.19 | 33.26 | 5.22 |
| Y | 7* | 0.055 | 0.15 | 0.20 | 31.23 | 5.15 |
| | 8 | 0.047 | 0.16 | 0.19 | 31.88 | 5.21 |
| | 9 | 0.048 | 0.17 | 0.22 | 32.90 | 5.09 |
| | 10* | 0.11 | 0.16 | 0.21 | 30.65 | 5.04 |
| | 11* | 0.10 | 0.16 | 0.25 | 31.24 | 5.10 |
| | 12 | 0.11 | 0.15 | 0.23 | 31.55 | 5.11 |
| | 13 | 0.11 | 0.16 | 0.17 | 32.08 | 5.09 |
| | 14 | 0.11 | 0.15 | 0.18 | 32.74 | 5.06 |
| | 15 | 0.11 | 0.16 | 0.17 | 33.25 | 5.07 |
| | 16* | 0.14 | 0.15 | 0.18 | 30.51 | 5.09 |

TABLE 1-continued

| Test Piece No. | Chemical Components C | Si | Mn | Ni | Co |
|---|---|---|---|---|---|
| 17 | 0.16 | 0.16 | 0.19 | 30.93 | 5.07 |
| 18 | 0.15 | 0.15 | 0.20 | 31.39 | 5.18 |
| 19 | 0.15 | 0.15 | 0.16 | 31.80 | 5.13 |
| 20 | 0.15 | 0.17 | 0.20 | 32.35 | 5.11 |
| 21 | 0.16 | 0.16 | 0.20 | 32.80 | 5.14 |
| 22 | 0.16 | 0.18 | 0.20 | 33.20 | 5.23 |
| 23 | 0.19 | 0.17 | 0.20 | 30.45 | 5.13 |
| 24 | 0.18 | 0.18 | 0.19 | 30.95 | 5.10 |
| 25 | 0.21 | 0.15 | 0.20 | 31.40 | 5.09 |
| 26 | 0.20 | 0.17 | 0.22 | 31.90 | 5.12 |
| 27 | 0.20 | 0.17 | 0.24 | 32.35 | 5.06 |
| 28 | 0.19 | 0.15 | 0.23 | 32.80 | 5.12 |
| 29 | 0.23 | 0.16 | 0.23 | 30.48 | 5.17 |
| 30* | 0.021 | 0.15 | 0.18 | 31.99 | 5.08 |
| 31 | 0.025 | 0.15 | 0.17 | 32.21 | 5.22 |
| 32 | 0.040 | 0.15 | 0.17 | 32.20 | 5.18 |
| 33 | 0.040 | 0.009 | 0.18 | 32.23 | 5.11 |
| 34 | 0.054 | 0.47 | 0.20 | 32.20 | 5.22 |
| 35 | 0.052 | 0.17 | 0.010 | 32.19 | 5.20 |
| 36 | 0.052 | 0.19 | 0.61 | 32.21 | 5.07 |
| 37 | 0.044 | 0.20 | 0.18 | 32.26 | 4.19 |
| 38 | 0.048 | 0.19 | 0.25 | 32.08 | 5.82 |

TABLE 2

| | Test Piece No. | Thermal Expansion Coefficient $\alpha$−20 to 120° C. (× $10^{-6}$/°C.) | Micro-structure | Segregation of Ni (wt %) |
|---|---|---|---|---|
| X | 1* | 5.55 | Z | 2.45 |
| | 2* | 4.42 | Z | 2.20 |
| | 3* | 3.54 | Z | 1.43 |
| | 4 | 0.90 | O | 0.70 |
| | 5 | 1.11 | O | 0.33 |
| | 6 | 1.53 | O | 0.24 |
| Y | 7* | 4.88 | Z | 1.83 |
| | 8 | 0.75 | O | 0.42 |
| | 9 | 1.38 | O | — |
| | 10* | 3.98 | Z | — |
| | 11* | 3.78 | Z | — |
| | 12 | 0.77 | O | — |
| | 13 | 1.03 | O | — |
| | 14 | 1.43 | O | — |
| | 15 | 1.62 | O | — |
| | 16* | 3.54 | Z | — |
| | 17 | 0.79 | O | — |
| | 18 | 0.83 | O | 0.34 |
| | 19 | 1.05 | O | — |
| | 20 | 1.33 | O | 0.28 |
| | 21 | 1.57 | O | 0.29 |
| | 22 | 1.78 | O | — |
| | 23 | 0.92 | O | — |
| | 24 | 0.90 | O | — |
| | 25 | 0.88 | O | 0.25 |
| | 26 | 1.10 | O | — |
| | 27 | 1.40 | O | — |
| | 28 | 1.60 | O | — |
| | 29 | 0.91 | O | — |
| | 30* | 3.74 | Z | — |
| | 31 | 0.84 | O | 0.58 |
| | 32 | 0.83 | O | — |
| | 33 | 0.83 | O | — |
| | 34 | 1.02 | O | — |
| | 35 | 0.82 | O | — |
| | 36 | 0.92 | O | — |
| | 37 | 0.90 | O | — |
| | 38 | 1.03 | O | — |

O austenite single phase maintained
Z martensite generated

From the "Table-1" and the "Table-2", the data of the test pieces having the chemical components of Si in the range of 0.10–0.20 weight %, Mn in the range of 0.15–0.25 weight %, and Co in the range of 5.0–5.30 weight % are picked up and plotted in the attached FIG. 1 with respect to the Ni content (in abscissa) and the C content (in ordinate) both in weight %.

In the FIG. 1, the line "a" indicates a boundary condition for the generation of martensite after the sub-zero treatment at −50° C. and is represented by a function % C=3.0285–0.0936×% Ni; the lines "b" and "c" respectively indicate boundary conditions for the therma expansion coefficients of $\alpha_{-20° \text{ to } 120°}$ C.=1.0×$10^{-6}$/°C. and $\alpha_{-20° \text{ to } 120° C.}$=1.5×$10^{-6}$/°C.; white circles indicate test pieces of the compositions which maintain the austenite single phase and the black circles those which generate the martensite; and the numbers indicated in the positions "e" and "f" (above and below the circles) correspond to the thermal expansion coefficient $\alpha_{-20° \text{ to } 120° C.}$ (×$10^{-6}$/°C.) and the test piece number, respectively.

It is clearly understood from the "Table-1", "Table-2" and FIG. 1, that the micro-segregation degree of Ni is reduced and the Ni content range required to show low expansion coefficient is shifted to a less Ni range and also is broadened, in accordance with the present invention. In effect, the lines "b" and "c" show inclinations ascending toward lefthand side and the horizontal distance between the lines "a" and "b" or "a" and "c" increases toward the left upper direction. More particularly, in the cast materials produced by the compositions within the range of prior art forged or rolled materials, the Ni content range required to show a stable structure after sub-zero cooling to −50° C. and satisfy $\alpha_{-20° \text{ to } 120° C.}$=1×$10^{-6}$/°C. is very narrow, only about 0.3% Ni, as shown by the distance "g" in FIG. 1. According to the present invention, such Ni content range is broadened, for example, to about 1.0% Ni at a representative carbon content of 0.15% C as shown by the distance "h" in FIG. 1. Moreover, in case the condition for the thermal expansion coefficient to be satisfied is made more lenient to an extent of $\alpha_{-20° \text{ to } 120° C.}$=1.5×$10^{-6}$/°C., such Ni content range is broadened from about 1.0% Ni in the prior art materials to about 2.0% Ni at the representative 0.15% C according to the present invention. This level of allowance is sufficient for control even under a mass production system.

As explained in detail in the above, the present invention has succeeded in reducing the micro-segregation of Ni, and broadening the Ni content range showing the low thermal expansion coefficient to an extent of substantially enabling mass production, by the addition of an appropriate amount of carbon C to 31 Ni-5 Co series iron alloys. The present invention thus is industrially very useful, as it has now enabled the obtaining a low expansion alloy at a low cost by casting under a mass production system, without relying upon the conventional forging or rolling process.

We claim:

1. A low thermal expansion cast alloy which consists essentially of, by weight percents;

0.02–0.25% of carbon (C),
30.5–33.3% of nickel (Ni),
4.0–6.0% of cobalt (Co),
0.005–0.70% of manganese (Mn),
0.005–0.50% of silicon (Si), and
the balance iron (Fe); and also satisfies the relationship relative to the weight percents of the carbon (C) and the nickel (Ni) that % C≧3.0285–0.0936×% Ni wherein % C and % Ni means weight percents of C and Ni, respectively.

* * * * *